US005645116A

United States Patent [19]

McDonald

[11] Patent Number: 5,645,116

[45] Date of Patent: Jul. 8, 1997

[54] METHOD AND ASSEMBLY FOR PREVENTING DRIPPING OF A LIQUID DISPENSING NOZZLE

[75] Inventor: Rodney R. McDonald, Ithaca, Mich.

[73] Assignee: Environmental Spout Company, Lansing, Mich.

[21] Appl. No.: 553,917

[22] Filed: Nov. 6, 1995

[51] Int. Cl.[6] ..... B67D 5/00

[52] U.S. Cl. ..... 141/208; 141/206; 141/207; 141/292; 141/311 A; 141/351; 222/108

[58] Field of Search ..... 141/116, 198, 141/206–211, 214, 215, 217, 218, 291, 292, 311 A, 351–354, 392; 222/108, 506, 509, 518

[56] References Cited

U.S. PATENT DOCUMENTS

| | | | |
|---|---|---|---|
| 566,898 | 9/1896 | Feroe . | |
| 2,035,438 | 3/1936 | Warren . | |
| 2,138,380 | 11/1938 | Killman et al. | 141/215 |
| 2,303,179 | 11/1942 | Sitton et al. | 141/208 |
| 2,703,195 | 3/1955 | Froidevaux | 141/215 |
| 2,713,988 | 7/1955 | Kitterman | 222/518 X |
| 2,764,324 | 9/1956 | Landreth | 222/518 X |
| 2,936,799 | 5/1960 | Mannon | 141/208 |
| 3,324,904 | 6/1967 | Crothers . | |
| 3,370,623 | 2/1968 | Murray | 141/206 |
| 3,521,679 | 7/1970 | Copony | 141/208 |
| 3,710,831 | 1/1973 | Riegel | 141/207 |
| 3,719,215 | 3/1973 | Murray | 141/207 |
| 3,881,528 | 5/1975 | Mackenzie | 141/208 X |
| 3,951,379 | 4/1976 | Cornelius | 251/118 |
| 3,982,571 | 9/1976 | Fenton et al. | 141/292 X |
| 3,994,323 | 11/1976 | Takahata et al. | 141/302 |
| 4,014,472 | 3/1977 | Bennett | 239/533.1 |
| 4,213,488 | 7/1980 | Pyle | 141/1 |
| 4,232,715 | 11/1980 | Pyle | 141/292 X |
| 4,749,010 | 6/1988 | Petell | 141/59 |
| 4,834,151 | 5/1989 | Law | 141/198 |
| 4,905,743 | 3/1990 | Gray | 141/198 |
| 4,925,069 | 5/1990 | Ueda et al. | 222/500 |
| 5,016,687 | 5/1991 | Kawamura | 141/116 |
| 5,069,260 | 12/1991 | Shea | 141/292 |
| 5,076,333 | 12/1991 | Law | 141/198 |
| 5,094,278 | 3/1992 | Arao et al. | 141/311 A |
| 5,249,611 | 10/1993 | Law | 141/198 |
| 5,255,720 | 10/1993 | McPherson | 141/86 |
| 5,377,729 | 1/1995 | Reep | 141/392 |

FOREIGN PATENT DOCUMENTS

| | | | |
|---|---|---|---|
| 468239 | 7/1937 | United Kingdom | 141/215 |
| 1027271 | 4/1966 | United Kingdom | 141/214 |

*Primary Examiner*—J. Casimer Jacyna
*Attorney, Agent, or Firm*—Ian C. McLeod; Mary M. Moyne

[57] ABSTRACT

A method and assembly (10) to prevent the dripping of a liquid dispensing nozzle (100) after deactivation of the nozzle and to automatically deactivate the nozzle when it is removed from the fuel tank (150), is described. The non-drip valve assembly is attached to the dispensing end (104B) of the nozzle and includes a housing (12) within which is mounted a valve (14) comprised of a stopper (16) and a spring (18). When the nozzle is activated, the liquid pressure on the extreme end (16D) of the stopper moves the stopper out of the opening (12E) in the proximal end (12A) of the housing which allows the liquid to flow into the housing around the stopper and out through the apertures (12G) in the sidewall (12C) of the housing. When the nozzle is deactivated, the spring biases the stopper into the opening which prevents liquid remaining in the spout from escaping. A shut-off sleeve (112) is mounted around the spout of the nozzle and has a spring and ball plunger (116) and a locating detent (124). In use, the sleeve slides along the spout of the nozzle exposing the venturi opening (110) as the nozzle is inserted into a fuel tank. Once the nozzle is removed from the tank, the return spring (114) biases the sleeve back along the spout to cover the venturi opening and deactivate the nozzle.

20 Claims, 4 Drawing Sheets

METHOD AND ASSEMBLY FOR PREVENTING DRIPPING OF A LIQUID DISPENSING NOZZLE

BACKGROUND OF THE INVENTION (1) Field of the Invention

The present invention relates to a method and assembly for filling a container with a liquid using a liquid dispensing nozzle which prevents dripping of the liquid from the nozzle after the nozzle has been deactivated. In particular, the present invention relates to a method and assembly for filling a container with a liquid using a liquid dispensing nozzle where a non-drip assembly is attached to the dispensing end of the nozzle and acts to close off the dispensing end of the nozzle once liquid pressure in the nozzle decreases due to the deactivation of the nozzle. The present invention also relates to a method and assembly for filling a container with a liquid using a liquid dispensing nozzle which prevents the nozzle from being activated when the nozzle is removed from the container.

There is an ever increasing concern about damage to the environment resulting from the contamination of ground water and soil due to spillage of vehicle fuels, petroleum substances and other chemicals. Part of the damage is caused by the dripping of excess liquid from the nozzle used to dispense the fuel or liquid, after the nozzle has been deactivated. In general, once the nozzle is deactivated, there remains a small amount of excess liquid in the nozzle. As the nozzle is removed from the fuel tank or container, the remaining liquid tends to drip from the dispensing end of the nozzle onto the surrounding ground surface or onto the user. In addition, part of the damage is caused by activation of the nozzle when the nozzle is removed from the container or fuel tank. Activation of a nozzle outside of a container or fuel tank also presents a safety problem due to the spillage of the flammable fuel. To help prevent spillage of the liquid, a non-drip assembly is needed to prevent the excess liquid from dripping from the end of the nozzle once the nozzle has been deactivated. To help eliminate spillage of fuel due to activation of the nozzle outside of the container, a shut off sleeve is needed to be used with the nozzle.

(2) Description of the Related Art

The related art has shown various apparatus for preventing a liquid dispensing nozzle from dripping liquid after the nozzle has been deactivated. Illustrative are U.S. Pat. No. 4,014,472 to Bennett; U.S. Pat. No. 4,213,488 to Pyle; and U.S. Pat. No. 5,377,729 to Reep.

Bennett describes a nozzle assembly for high speed filling units. The nozzle assembly includes an upper casing within which is mounted a nozzle piston structure. The piston structure is fastened to an inner, hollow sleeve member to move the sleeve member. The sleeve member is provided with openings adjacent the piston structure to allow for communication between the inner space of the hollow sleeve member and the cylinder space. The end of the inner sleeve member opposite the piston structure is provided with discharge openings and a plug-like end closure member. A spring mounted around the inner sleeve member acts to bias the sleeve into the closed position. An outer sleeve member is slidably mounted around the inner sleeve member and is fixably secured to the lower casing of the nozzle assembly. In operation, the pressure of the fluid causes the piston to open which in turn moves the inner sleeve member outward thus, moving the end of the inner sleeve member beyond the outer sleeve member which exposes the discharge openings. Once the flow of fluid stops, the spring biases the piston structure and the inner sleeve member into the closed position.

Pyle describes a valve located in the end of a nozzle for preventing the flow of fuel and fuel vapors out of the nozzle when the nozzle is deactivated. In one embodiment, a pinch valve is located at the end of the nozzle. The pinch valve consists of a resilient sleeve and is designed to open and close by the action of air or hydraulic pressure acting on the resilient sleeve. A fluid passageway is provided to establish communication between the pinch valve and the flow passage upstream of the flow control valve. When the nozzle is deactivated, the pinch valve is in fluid contact with the flow passage such that the pressure from the fluid flowing to the pinch valve acts to close the pinch valve. When the nozzle is activated, a passageway is formed between the fluid passageway and the flow passage downstream of the flow control valve such that the fluid flows out of the fluid passage and the pinch valve and out of the flow passage. In another embodiment, a wafer valve is mounted in the end of the nozzle and acts to seal the end of the nozzle. The wafer valve consists of two substantially semi-circular discs pivotally arranged around a shaft which extends from one side of the end of the nozzle to the other to support the discs. The wafer valve uses a similar construction as described above to open and close.

Reep describes a check valve device for a fuel pump nozzle. The device includes a stopper having a stem mounted on a plug member. The plug member is sized to close the dispensing end of the nozzle. A support member is mounted on the stem of the stopper to guide and support the stopper. The support member has two extension members mounted in an essentially U-shaped manner. The extensions engage the inside wall of the nozzle to hold the support member securely within the passage. The support member is shaped to allow the fuel to pass through the nozzle. A spring is mounted between the end of the stem opposite the plug member and the support member. The spring acts to bias the stopper back into engagement with the end of the nozzle. In operation, the plug member is seated within the end of the nozzle when fuel is not being dispensed. Once the fuel pump is activated, the fuel pressure on the plug member acts to move the plug member out of engagement with the end of the nozzle. Once the pump is deactivated, the force acting to disengage the plug member is less than the force of the spring acting to move the plug member back into engagement with the end of the nozzle. Consequently, the plug member acts to close the end of the nozzle such as to prevent the nozzle from dripping.

Also of some interest are U.S. Pat. No. U.S. Pat. No. 3,324,904 to Crotners; U.S. Pat. No. 4,749,010 to Petell; and U.S. Pat. No. 4,834,151; and U.S. Pat. No. 5,249,611 all to Law which show non-drip apparatus which are activated by removal of the nozzle from contact with the container.

Further, of interest are U.S. Pat. No. U.S. Pat. No. 2,936,799 to Mannon; U.S. Pat. No. 3,521,679 to Copony; U.S. Pat. No. 3,994,323 to Takahata et al and U.S. Pat. No. 5,076,333 to Law which show the closing off of the venturi opening or the air vent tube in response to removal of the nozzle from the container or fuel tank which stops the flow of liquid in the nozzle.

There remains a need for a liquid dispensing nozzle which will not drip excess liquid once the nozzle is deactivated and which will automatically deactivate the nozzle when it is removed from the fuel tank or container.

OBJECTS

It is an object of the present invention to provide an apparatus to prevent the dripping of liquid from a liquid dispensing nozzle after the nozzle has been deactivated. Further, it is an object of the present invention to provide an apparatus for preventing the dripping of liquid from a liquid dispensing nozzle which closes off the dispensing end of the nozzle in response to a loss of liquid pressure in the nozzle. Still further, it is an object of the present invention to provide a method for filling a container using a liquid dispensing nozzle without having excess liquid drip from the dispensing end after the nozzle has been deactivated. Further still, it is an object of the present invention to provide an apparatus for preventing the dripping of liquid from a liquid dispensing nozzle which is configured to be connected to the dispensing end of the nozzle. Further, it is an object of the present invention to provide an apparatus to prevent the dripping of liquid from a liquid dispensing nozzle which is inexpensive to manufacture and which can be used with standard, liquid dispensing nozzles. These and other objects will become increasingly apparent by reference to the following drawings and the description.

DETAILED DESCRIPTION OF THE PREFERRED EMBODIMENTS

Figure 1:
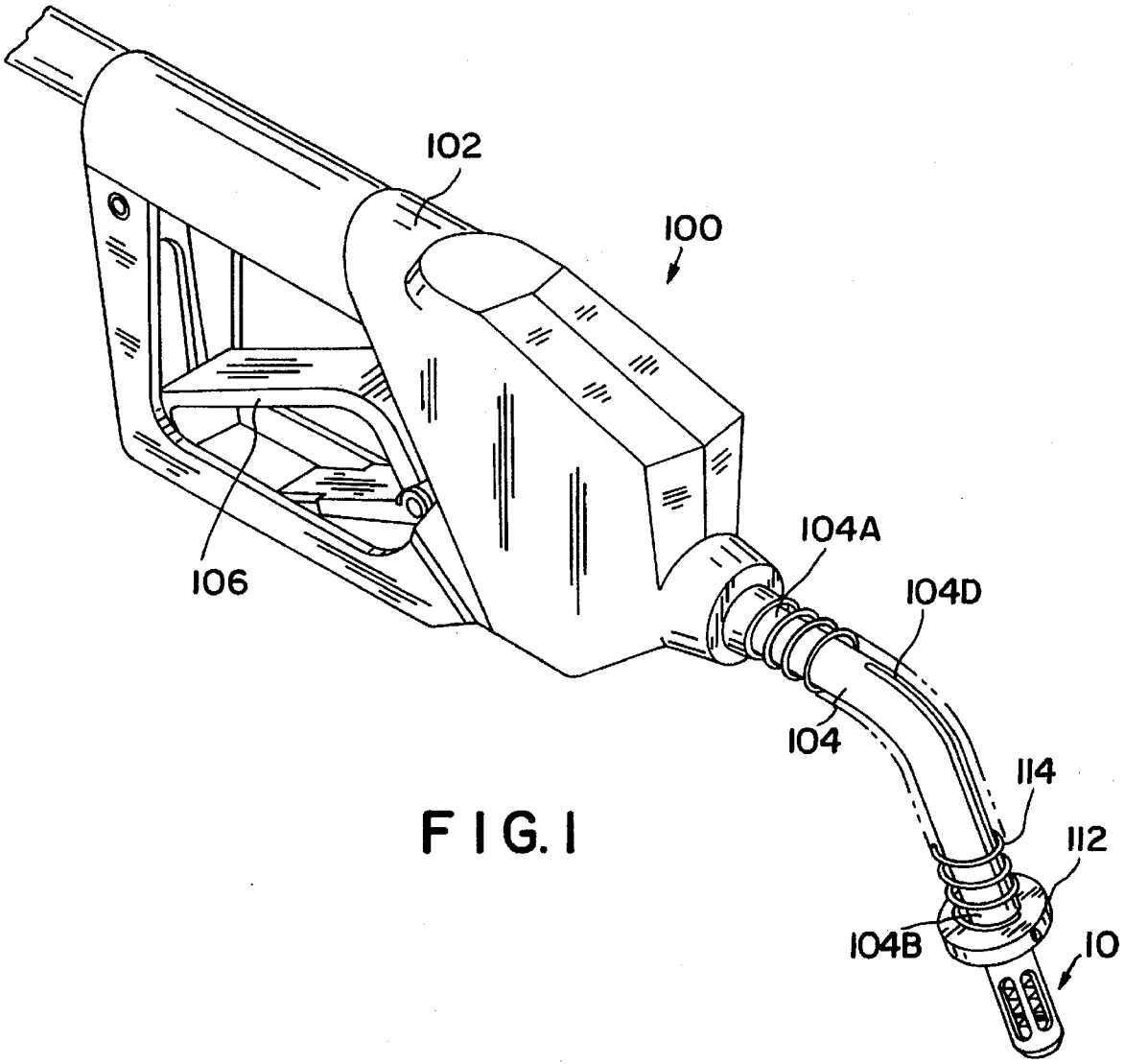
FIG. 1 is a perspective view of the non-drip valve assembly 10 attached to the dispensing end 104B of the nozzle 100.
Figure 2:
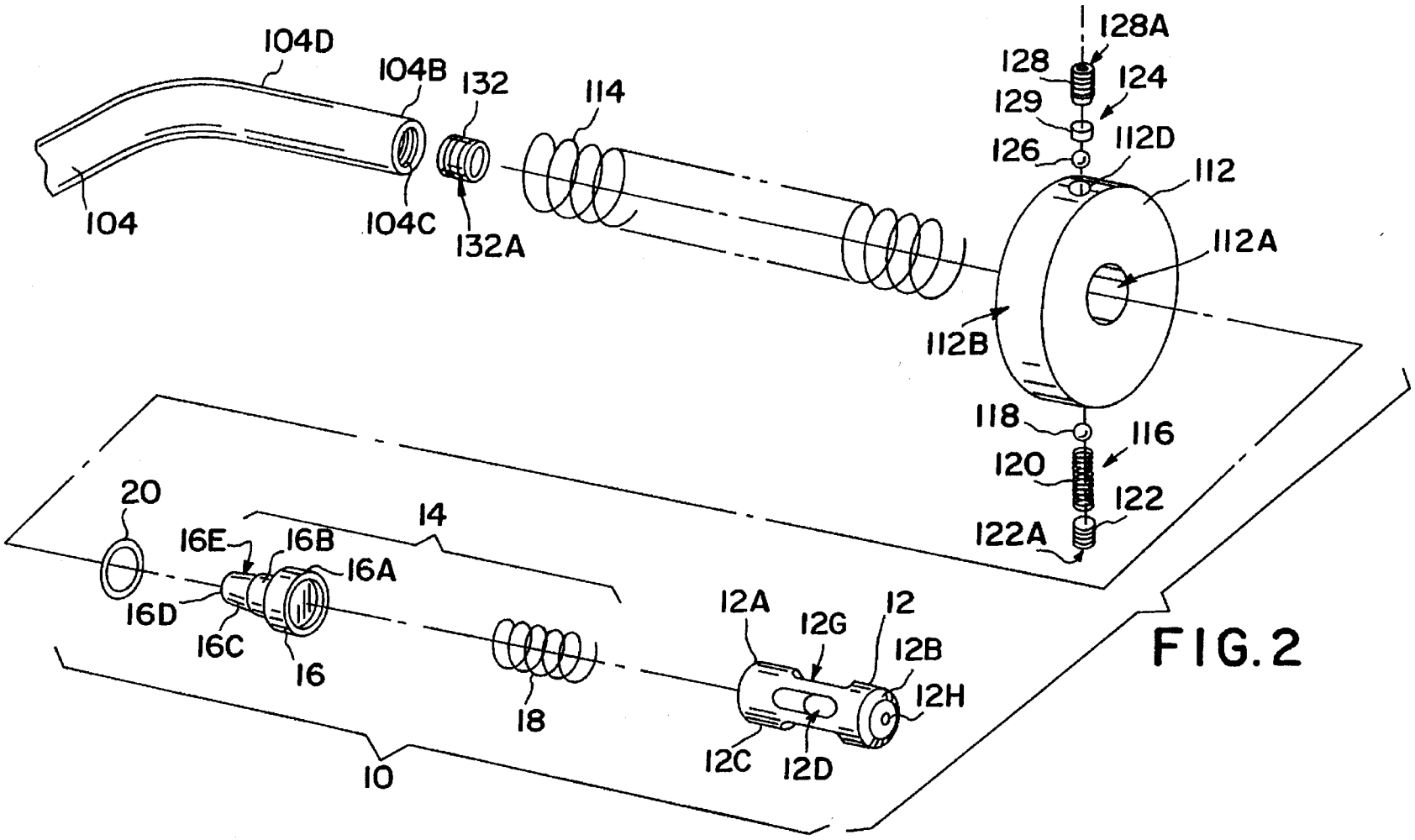
FIG. 2 is an exploded view of the non-drip valve assembly 10 connected to the dispensing end 104B of the nozzle 100 with the automatic shut-off sleeve 112 showing the o-ring 20, the stopper 16, the coil spring 18 and the housing 12.

The present invention relates to a non-drip assembly for use with a liquid dispensing nozzle, which comprises: a conduit having opposed ends with a sidewall therebetween providing a channel along a longitudinal axis of the assembly, one of the ends having an opening and being configured to be connected to the nozzle; a valve means mounted in the channel between the ends of the conduit to control a flow of a liquid from the nozzle into the assembly and out an aperture adjacent the valve means which includes: a stopper to close the opening in the one end of the conduit; a biasing means to move the stopper toward the opening in the one end of the conduit to close the opening and control the flow of liquid into the assembly to prevent the liquid from dripping from the nozzle after the nozzle has been deactivated.

Further, the present invention relates to a non-drip assembly for use with a liquid dispensing nozzle, which comprises: a conduit having opposed ends with a sidewall therebetween providing a channel along a longitudinal axis of the assembly, the sidewall having an aperture and one of the ends of the conduit having an opening and being configured to connect to a dispensing end of the liquid dispensing nozzle; a valve means mounted in the channel of the conduit adjacent the aperture in the sidewall to control a flow of liquid into the assembly including: a stopper mounted adjacent to the opening in the one end of the conduit and configured to extend into the opening in the one end of the conduit to close the opening to prevent the flow of liquid into the assembly; a biasing means mounted adjacent the stopper to move the stopper into the opening of the one end of the conduit wherein after deactivation of the nozzle, liquid pressure forcing the stopper in a direction away from the opening is less than a force of the biasing means tending to move the stopper toward the opening.

Still further, the present invention relates to a method for using a liquid dispensing nozzle to fill a container without having excess liquid flowing out of a dispensing end of the liquid dispensing nozzle after the nozzle has been deactivated, which comprises: providing a non-drip assembly connected to the dispensing end of the nozzle which comprises: conduit having opposed ends with a sidewall therebetween providing a channel along a longitudinal axis of the assembly, one of the ends having an opening and being configured to be connected to the nozzle; a valve means mounted in the channel between the ends of the conduit to control a flow of the liquid from the nozzle into the assembly and out an aperture adjacent the assembly which includes: a stopper to close the opening in the one end of the conduit; a biasing means to move the stopper toward the opening in the one end of the conduit to close the opening and control the flow of liquid into the assembly to prevent the liquid from dripping from the nozzle after the nozzle has been shut off; inserting the dispensing end of the nozzle with the assembly into the container to be filled; activating the nozzle such that the flow of liquid in the nozzle contacts the stopper at the dispensing end of the nozzle and acts to move the stopper away from the opening in the one end of the conduit so that the liquid flows through the assembly and into the container; deactivating the nozzle to stop the flow of liquid in the nozzle so that the stopper is moved toward the opening in the one end of the conduit by the biasing means such as to close the opening in the one end of the conduit and prevent excess liquid in the nozzle from exiting the dispensing end of the nozzle through the opening in the assembly; and removing the nozzle from the container.

Further still, the present invention relates to a liquid dispensing nozzle, the improvement which comprises: a conduit having a proximal end and an opposed distal end with a sidewall therebetween providing a channel through the conduit, the proximal end being connected to a handle of the nozzle and the sidewall having an aperture adjacent the distal end to dispense a liquid; a valve means mounted in the channel at the distal end of the conduit adjacent the aperture in the sidewall and including: a stopper to control a flow of the liquid through the aperture in the sidewall of the conduit; and a biasing means to move the stopper to close the channel of the conduit adjacent the aperture in the sidewall to prevent the liquid from exiting the conduit through the aperture in the sidewall after the nozzle has been deactivated.

Further, the present invention relates to a liquid dispensing nozzle including a conduit having a proximal end and an opposed distal end with a sidewall therebetween providing a channel through the conduit, the proximal end being connected to a handle of the nozzle and the distal end having an opening for dispensing a liquid; a venturi shut off mechanism to deactivate the nozzle, having a venturi tube extending along the channel of the conduit from the handle of the nozzle to a venturi opening in the sidewall of the conduit adjacent the distal end of the conduit, the improvement which comprises: a shut off sleeve slidably mounted around an outside surface of the conduit; a plunger mounted in the sleeve such that a ball of the plunger extends into the venturi opening when the sleeve is in the fully forward position and acts to close off the venturi opening such as to deactivate the nozzle; and a biasing means mounted around the outside surface of the conduit between the sleeve and the handle to move the sleeve into the fully forward position when the nozzle is removed from a container.

The assembly is preferably connected by a threaded connector to the dispensing end of a standard gasoline nozzle. The threaded connector preferably has an inner diameter smaller than the inner diameter of the conduit and nozzle and smaller than the outer diameter of the top portion of the stopper such as to prevent the stopper of the valve from extending beyond the proximal end of the conduit. The conduit of the assembly preferably is cylindrical in shape with an outer diameter equal to the outer diameter of the nozzle. The conduit preferably has at least four (4) apertures in the sidewall extending parallel to the longitudinal axis of the assembly. The other end of the assembly preferably also has a hole around the longitudinal axis of the assembly. The stopper preferably has a frustoconical bottom portion which extends into and through the opening in the one end of the assembly. The top portion of the stopper is preferably cylindrical with an outer diameter slightly smaller than the inner diameter of the conduit. An inner ring is mounted in the channel of the conduit and provides a seal between the assembly and the nozzle. The nozzle may also be provided with an automatic shut-off sleeve which mounts around the outside of the nozzle and acts to close off the venturi opening of a venturi mechanism in the nozzle when the nozzle is removed from the container.

Figure 3:
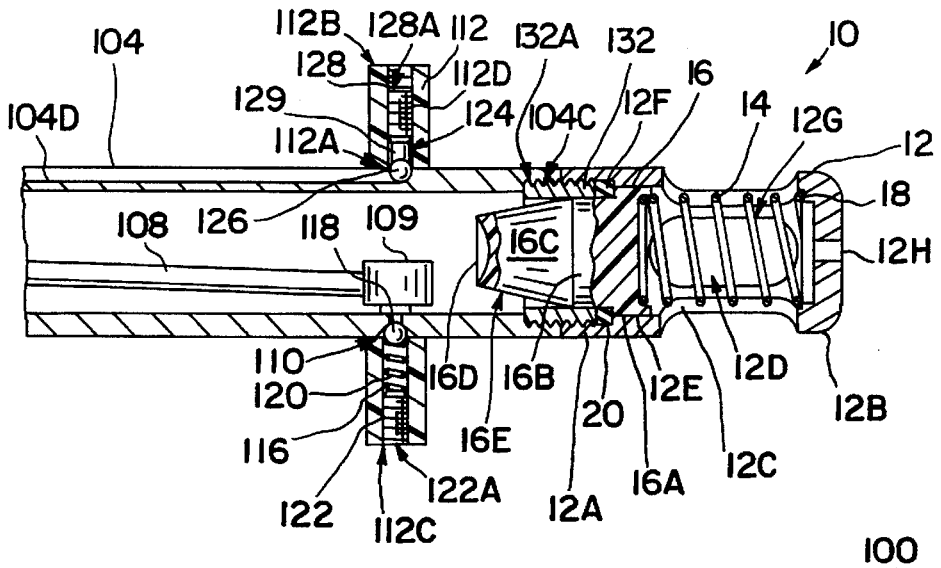
FIG. 3 is a cross-sectional view of the non-drip valve assembly 10 attached to the dispensing end 104B of the nozzle 100 with the shut-off sleeve 112 showing the stopper 16 extending through the opening in the proximal end 12A of the housing 12.
Figure 4:
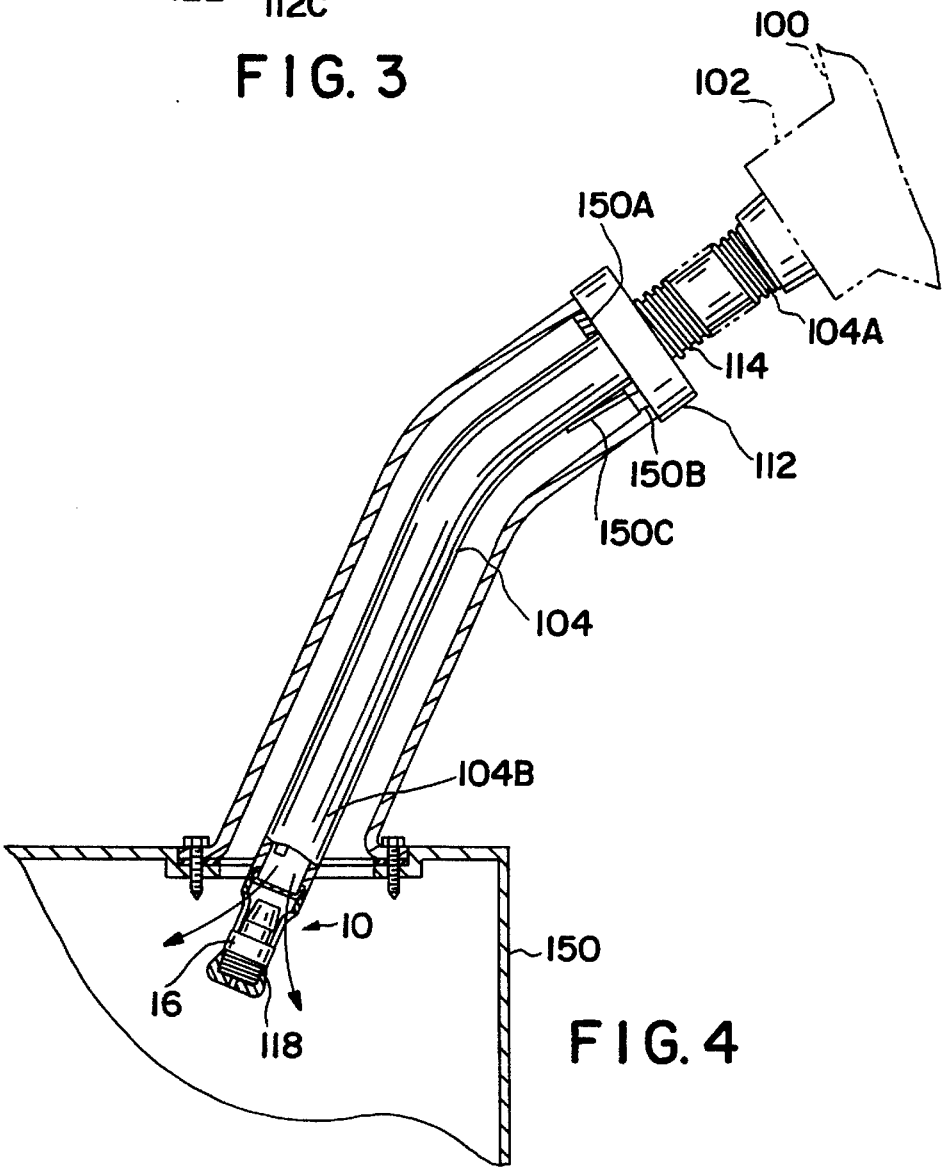
FIG. 4 is a cross-sectional view of the non-drip assembly 10 mounted on the nozzle 100 with the shut-off sleeve 112 and inserted into a fuel tank 150.

FIGS. 1 to 4 show the non-drip valve assembly 10 of the present invention. The assembly 10 is configured to be attached to a dispensing end 104B of a standard liquid dispensing nozzle 100 such as those used to fill a fuel tank 150 on vehicles. The fuel tanks 150 are preferably similar to the fuel tank of conventional vehicles and has an opening 150A surrounded by a rim 150B and also has a vapor flap 150C which automatically covers the opening 150A when the nozzle 100 is removed (FIG. 4). The valve assembly 10, however, may also be constructed as part of the original equipment of the nozzle 100. In addition, the valve assembly 10 may be used on any type of nozzle 100 which dispenses fluids under pressure.

The standard liquid dispensing nozzle 100 preferably includes a handle portion 102 and a spout 104 (FIG. 1). The spout 104 is preferably cylindrical with opposed ends 104A and 104B forming a passage for the fluid. The end 104A of the spout 104 opposite the dispensing end 104B of the spout 104 is mounted on the handle portion 102 of the nozzle 100. The handle portion 102 includes a trigger 106 for activating the nozzle 100. The nozzle 100 preferably also has an overflow shut-off system for automatically deactivating the nozzle 100 when the liquid in the container (not shown) or fuel tank 150 reaches a certain level. The system preferably includes a venturi valve (not shown) connected by a venturi tube 108 with an end fitting 109 having an orifice which is in communication with a venturi opening 110 near the dispensing end 104B of the spout 104 (FIG. 3). Preferably the venturi valve is similar to those well known in the art such as that described in U.S. Pat. No. 3,710,831 to Riegel. When the liquid in the fuel tank 150 reaches and closes off the venturi opening 110 the venturi valve is triggered to deactivate the nozzle 100.

An automatic shut-off sleeve 112 is preferably provided on the outside of the spout 104. The sleeve 112 preferably has a circular cross-section with a hole in the middle such as to form an inner wall 112A and an outer wall 112B. The hole preferably has a diameter slightly larger than the outer diameter of the spout 104 such that the sleeve 112 is able to be mounted around the spout 104 and able to move along the length of the spout 104. The sleeve 112 is preferably about 2.00 inches (5.08 cm) in diameter with a thickness of about 0.50 inches (1.27 cm). The sleeve 112 may be of any size provided the sleeve 112 makes contact with the rim 150B around the opening 150A of the fuel tank 150 which slides the sleeve 112 upward and enables the nozzle 100 to be activated. The sleeve 112 is preferably constructed of nylon although, other materials which are structurally competent, chemically-inert and sparkless may also be used. The sleeve 112 is also preferably constructed of a light material such as to not increase the weight of the nozzle 100. A return spring 114 is preferably mounted about the spout 104 between the handle portion 102 of the nozzle 100 and the shut-off sleeve 112. The return spring 114 is preferably of such a force as to bias the sleeve 112 into the closed position when pressure is removed from the outer side of the sleeve 112. The return spring 114 for the sleeve 112 is preferably constructed of 0.051 inch (0.130 cm) diameter stainless steel wire with an outer diameter of 0.980 inches (2.490 cm) and with a compressive force rating of 12 oz. per inch.

The sleeve 112 is preferably provided with a first and second aperture 112C and 112D in which are mounted a spring and ball plunger 116 and a locating detent 124, respectively. The first aperture 112C preferably extends through the sleeve 112 between the inner and outer walls 112A and 112B and is located such that when the sleeve 112 is mounted on the spout 104, the spring and ball plunger 116 is perpendicular to the longitudinal axis of the spout 104. The spring and ball plunger 116 preferably includes a ball 118, a spring 120 and an adjustment screw 122. The plunger is mounted in the first aperture 112C in the sleeve 112 such that the ball 118 of the plunger is adjacent the inner wall 112A of the sleeve 112, the head 122A of the adjustment screw 122 is adjacent the outer wall 112B and the spring 18 is spaced therebetween. The diameter of the first aperture 112C is preferably slightly larger than the outer circumference of the ball 118 and the outer diameter of the spring 18 such that the spring and ball 116 are inserted into the aperture 112C from the outer wall 112B and fall through the aperture 112C to the inner wall 112A of the sleeve 112. In the preferred embodiment, the spring and ball plunger 116 is mounted in the first aperture 112C after the sleeve 112 has been fastened onto the spout 104. The sleeve 112 is preferably located on the nozzle 100 such that in the initial, at rest or closed position, the first aperture 112C is spaced over the venturi opening 110 such that when the ball 118 of the spring and ball plunger 116 is dropped into the first aperture 112C, the ball 118 falls through the aperture 112C and into the venturi opening 110. Preferably, the diameter of the ball 118 is slightly smaller than the diameter of the venturi opening 110 but slightly larger than the diameter of the orifice of the end fitting 109 of the venturi tube 108 such that the ball 118 passes completely through the opening 110 but does not pass completely through the orifice of the end fitting 109 of the venturi tube 108. The ball 118 preferably has an outer diameter of 0.187 inches (0.475 cm). The venturi opening 110 preferably has a diameter of about 0.19 to 0.25 inches (0.48 to 0.64 cm) and the orifice of the end fitting 109 of the venturi tube 108 inside preferably has a diameter of about 0.125 inches (0.318 cm). The spring 120 for the ball and spring plunger 128 is preferably a coil spring constructed of 0.017 inches (0.043 cm) stainless steel wire with an outer diameter of 0.195 inches (0.495 cm). The first aperture 112C is preferably threaded adjacent the outer wall 112B such as to be able to threadably mate with the threads of the adjustment screw 122.

The second aperture 112D is mounted through the sleeve 112 similarly to the first aperture 112C. Preferably, the second aperture 112D is spaced approximately about 180° from the first aperture 112C. The second aperture 112D may be spaced anywhere around the circumference of the sleeve 112 provided the second aperture 112D does not interfere with the spring and ball plunger 116. The locating detent 124 mounted in the second aperture 112D includes a ball 126 and an adjustment screw 128. The locating detent 124 is mounted in the second aperture 112D such that the ball 126 is adjacent the inner wall 112A of the sleeve 112 and the head 128A of the screw 128 is adjacent the outer wall 112B of the sleeve 112. A spacer 129 is preferably provided between the screw 128 and the ball 126. The spacer 129 is preferably constructed of nylon or a similar material which allows the ball 126 to rotate freely with very little friction against the spacer 129. The easy rotation of the ball 126 allows the sleeve 112 to be easily moved along the spout 104 of the nozzle 100. As with the first aperture 112C, the second aperture 112D preferably has a diameter larger than the diameter of the ball 126 such that when the ball 126 is inserted into the aperture 112D, the ball 126 drops completely through the aperture 112D to the inner wall 112A of the sleeve 112. Preferably, the outside surface of the spout 104 is provided with a locating groove 104D running along the length of the spout 104, parallel to the longitudinal axis of the spout 104. The groove 104D preferably extends from a point spaced apart from the handle portion 102 of the nozzle 100 to a point spaced apart from the dispensing end 104B of the nozzle 100. The sleeve 112 is preferably mounted on the spout 104 such that the second aperture 112D is spaced above the groove 104D and the ball 126 of the detent 124 extends into the groove 104D of the spout 104. The ball 126 preferably has an outer diameter of 0.187 inches (0.475 cm). The groove 104D preferably has a depth of 0.040 inches (0.102 cm). The end of the groove 104D which is spaced apart from the dispensing end 104B of the spout 104, forms a stop which prevents the ball 126 of the detent 124 and consequently, the shut-off sleeve 112 from extending beyond the end of the groove 104D. The ball 126 extending into the groove 104D also prevents the sleeve 112 from rotating around the spout 104. The ball 118 of the ball and spring plunger 116 when located in the venturi opening 110 also helps to prevent the sleeve 112 from sliding off the spout 104 and from rotating around the spout 104. In the preferred embodiment, when in the fully closed position, the sleeve 112 is spaced approximately about 0.375 inches (0.953 cm) from the dispensing end 104B of the nozzle 100. The placement of the sleeve 112 is dependent upon the location of the venturi opening 110 in the spout 104 of the nozzle 100. The balls 118 and 126 used for the locating detent 124 and the ball and spring plunger 116 are preferably the same size to cut down on the cost of manufacture. The balls 118 and 126 and spring 120 are preferably constructed of a chemically-inert, non-spark material as necessary to prevent the possibility of igniting the fluids in the nozzle 100 as a result of sparks due to friction.

Figure 5:
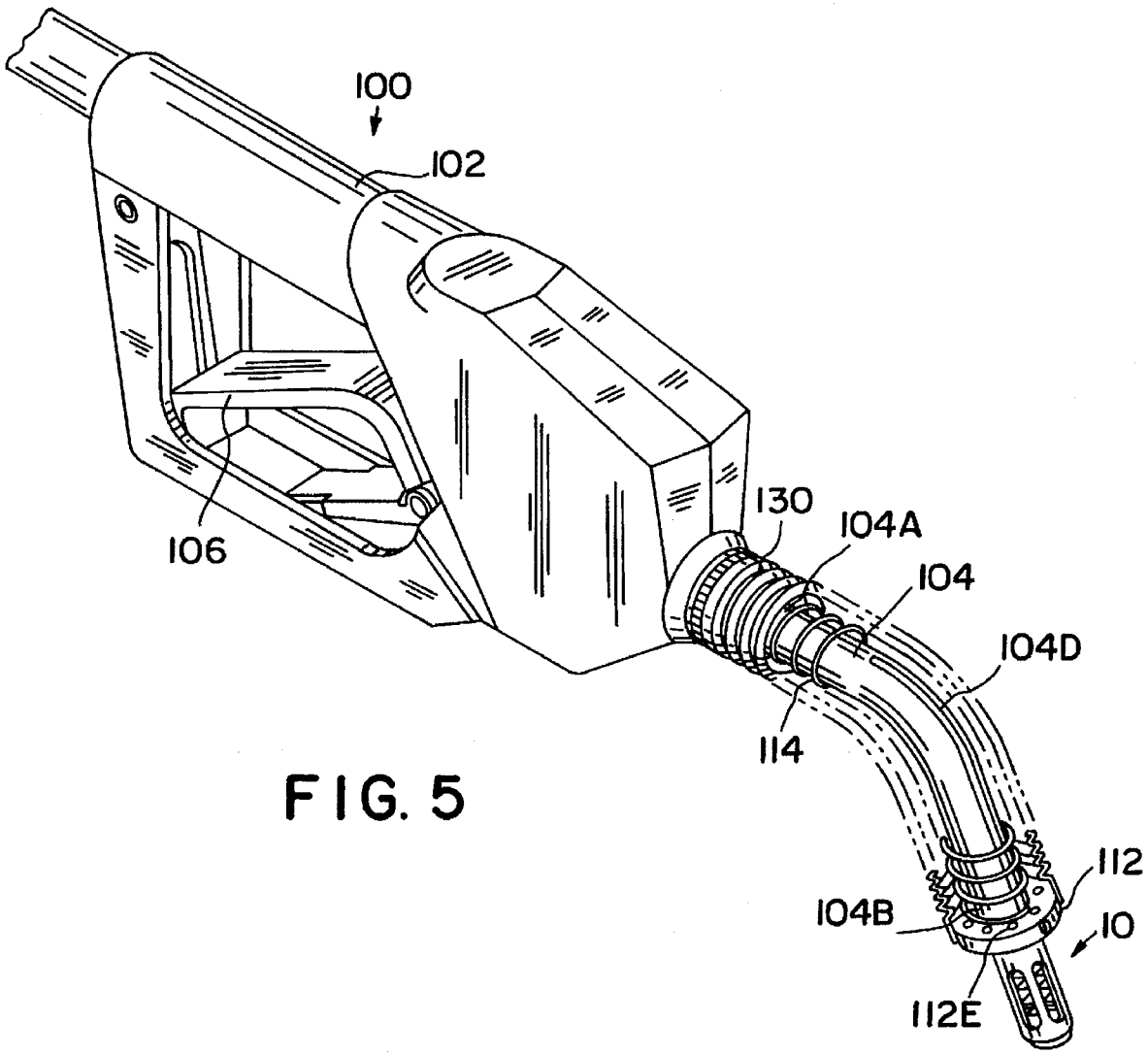
FIG. 5 is a perspective view of the non-drip valve assembly 10 connected to the dispensing end 104B of the nozzle 100 with the vapor boot 130.

Optionally, the nozzle 100 may also be provided with a vapor receiving boot 130 (FIG. 5). The boot 130 is attached at the distal end to the sliding sleeve 112 and at the proximal end to the handle portion 102 of the nozzle 100. The sliding sleeve 112 is provided with orifices 112E through which the fumes from the liquid escape from the fuel tank 150 into the vapor receiving boot 130. Preferably, the boot 130 is similar to those well known in the art and therefore does not need to be described in detail.

The non-drip valve assembly 10 includes a housing 12 or conduit within which is mounted the valve 14. The housing 12 is preferably cylindrical in shape having a proximal end 12A and a distal end 12B with a sidewall 12C spaced therebetween forming a passage or channel 12D along the longitudinal axis A—A of the assembly 10. The proximal end 12A of the housing 12 has an opening 12E which extends into the passage 12D. The inner surface of the proximal end 12A adjacent the opening 12E is preferably provided with threads 12F which are configured to mate with the threads 132A of a threaded connector 132. The connector 132 is mounted with one end engaging the threads 12F in the proximal end 12A of the housing 12 and the other end engaging the threads 104C on the inner surface of the dispensing end 104B of the spout 104 of the nozzle 100. Preferably, the connector 132 is approximately about 0.313 inches (0.794 cm) in length and extends an equal distance into both the dispensing end 104B of the spout 104 of the nozzle 100 and the proximal end 12A of the housing 12 of the assembly 10. The threaded connector 132 has an inner diameter less than the outer diameter of the top portion 16A of the stopper 16 such as to prevent the stopper 16 from extending completely through the opening 12E in the proximal end 12A of the housing 12. Other connectors (not shown) may also be used to mount the assembly 10 on the dispensing end 104B of the spout 104. In addition, the assembly 10 may be permanently mounted on the nozzle 100 such as by welding or may be constructed as part of the dispensing end 104B of the spout 104 of the nozzle 100. If formed as part of the spout 104, the spout 104 must be provided with holes (not shown) to allow the liquid to flow out of the spout 104 when the valve 14 of the assembly 10 is open. In this case, a shoulder or ridge (not shown) would be provided in the passage 12D of the housing 12 adjacent the holes in the dispensing end 104B of the spout 104 of the nozzle 100 such as to prevent the stopper 16 from extending too far toward the proximal end 104A of the spout 104. The outer diameter of the housing 12 is preferably similar to the outer diameter of the spout 104 such that the outer diameters of the assembly 10 and the spout 104 match when the assembly 10 is attached to the dispensing end 104B of the spout 104. The similarities of the outer diameters prevent the assembly 10 from creating problems when the nozzle 100 is inserted into the fuel tank 150 and also increases the aesthetic quality of the assembly 10. In the preferred embodiment, when the assembly 10 is mounted on the dispensing end 104B of the spout 104, the longitudinal axis of the spout 104 is coincidental with the longitudinal axis A—A of the assembly 10.

The sidewall 12C of the housing 12 is preferably provided with apertures 12G which extend along the length of the assembly 10 parallel to the longitudinal axis A—A of the assembly 10. In the preferred embodiment, there are four (4) apertures 12G spaced equally around the circumference of the assembly 10. The apertures 12G are preferably oval in shape and are between about 0.750 and 0.800 inches (1.905 and 2.032 cm) long and between about 0.375 and 0.400 inches (0.953 and 1.016 cm) wide. The size and shape of the apertures 12G is such as to provide undisturbed flow of the liquid through the opening 12E around the stopper 16 and out the apertures 12G. The distal end 12B of the housing 12 is preferably provided with a hole 12H extending parallel to the longitudinal axis A—A of the assembly 10. The hole 12H is preferably in the center of the end 12B and allows liquid trapped in the passage 12D of the housing 12 beyond the apertures 12G to escape the assembly 10. The distal end 12B is preferably also provides a resistant wall for the spring 18 of the valve 14 (to be described in detail hereinafter).

The valve 14 is mounted in the passage 12D of the housing 12 between the ends 12A and 12B of the housing 12. The valve 14 is comprised of a stopper 16 and a spring 18. The valve 14 is mounted such that the spring 18 is adjacent the distal end 12B of the housing 12 and the stopper 16 is adjacent the proximal end 12A of the housing 12. The stopper 16 preferably has a top portion 16A, a flat middle portion 16B and a frusto-conical bottom portion 16C. The top portion 16A preferably has an outer diameter greater than the outer diameter of the middle portion 16B such that a shoulder is formed at the junction of the top and middle portions 16A and 16B. The stopper 16 is mounted in the passage 12D such that when in the fully extended, closed position, the top portion 16A is adjacent the spring 18 and the middle and bottom portions 16B and 16C extend outward through the opening 12E in the proximal end 12A of the housing 12 (FIG. 3). The side of the top portion 16A opposite the middle portion 16B is provided with a c-bore to hold the end of the spring 18. Alternatively, the top portion 16A opposite the middle portion 16B is provided with an extension (not shown) around which the end of the spring 18 is mounted. The outer diameter of the top portion 16A is preferably slightly smaller than the inner diameter of the housing 12 such that the stopper 16 is able to slide easily within the passage 12D of the housing 12 and is able to pass completely through the opening 12E in the proximal end 12A of the housing 12. The ability of the stopper 16 to extend completely through the opening 12E allows for easier construction of the assembly 10 and for easier repair of the assembly 10. The outer diameter of the top portion 16A of the stopper 16 is preferably greater than the inner diameter of the threaded connector 132 such that when the assembly 10 is connected to the dispensing end 104B of the spout 104 of the nozzle 100, the threaded connector 132 prevents the stopper 16 from extending completely through the opening 12E in the proximal end 12A of the housing 12 and into the spout 104 of the nozzle 100. The outer diameter of the top portion 16A of the assembly 10 is of such a size as to prevent extraneous side-to-side motion and tilting or pivoting motion of the stopper 16. The middle portion 16B of the stopper 16 has an outer diameter slightly smaller than the threaded connector 132 and the o-ring 20 (to be described in detail hereinafter) such as to be able to extend beyond the end of the threaded connector 132 and the o-ring 20. The stopper 16 is preferably 0.625±0.005 inches (1.586±0.013 cm) in length. The top portion 16A of the stopper 16 is preferably 0.250 inches (0.635 cm) in length and has an outer diameter of between about 0.623 and 0.627 inches (1.582 and 1.593 cm). The middle portion 16B of the stopper 16 preferably has a length of about 0.100 inches (0.254 cm) and an outer diameter of between about 0.545 and 0.550 inches (1.384 and 1.397 cm). The bottom portion 16C preferably has an outer diameter of 0.19 inches (0.48 cm) at the extreme end 16D opposite the top portion 16A. The extreme end 16D of the bottom portion 16C of the stopper 16 preferably has a concave surface to enable the liquid pressure in the nozzle 100 to act against the extreme end 16D to move the stopper 16 away from the opening 12E of the housing 12 of the assembly 10 (FIG. 3). The angle of the sidewall 16E of the bottom portion 16C of the stopper 16 is approximately about 30°. The angled sidewall 16E of the bottom portion 16C of the stopper 16 allows for maximum flow of the liquid around the stopper 16 when the nozzle 100 is activated.

In the preferred embodiment, the stopper 16 is mounted such that in the closed position the bottom portion 16C of the stopper 16 extends through the opening 12E in the housing 12 and beyond the proximal end 12A approximately about 0.25 inches (0.64 cm). The stopper 16 extends beyond the proximal end 12A of the housing 12 a distance less than the distance between the proximal end 12A of the housing 12 and the end fitting 109 of the venturi tube 108 in the nozzle 100 when the assembly 10 is mounted on the dispensing end 104B of the nozzle 100 (FIG. 3). In the closed position, the top portion 16A of the stopper 16 preferably extends into the housing 12 such as to extend into the portion of the passage 12D surrounded by the apertures 12G in the sidewall 12C. In the preferred embodiment, when the stopper 16 is in the fully open position, the stopper 16 is completely within the area of the channel surrounded by the apertures 12G (FIG. 4). The stopper 16 is preferably constructed of nylon such as to be durable and lightweight. The stopper 16 may also be constructed of plastic or any other chemically-inert material which is also sparkless. Preferably, the stopper 16 is also lightweight and has a smooth outer surface such as to reduce the amount of friction between the outer surface of the stopper 16 and the sidewall 12C of the housing 12. The size and shape of the stopper 16 and the size and shape of the passage 12D of the housing 12 allow for sliding of the stopper 16 along the longitudinal axis A—A of the assembly 10.

The spring 18 of the valve 14 is preferably mounted between the top portion 16A of the stopper 16 and the distal end 12B of the housing 12. In the preferred embodiment, the spring 18 is a coil spring 18 with an outer diameter slightly smaller than the inner diameter of the housing 12 which allows the spring 18 to be inserted into the housing 12 through the opening 12E in the proximal end 12A of the housing 12. The spring 18 preferably has a force such as to move the stopper 16 toward the opening 12E in the proximal end 12A of the housing 12 when there is little or no liquid pressure pushing on the extreme end 16D of the bottom portion 16C of the stopper 16. In the preferred embodiment, the spring 18 has an outer diameter of 0.545 inches (1.384 cm), and a compressive force rating of 10 oz. The spring 18 is preferably constructed of 0.026 inches (0.066 cm) stainless steel wire.

An o-ring 20 is preferably mounted in the passage 12D of the housing 12 adjacent the threads 12F on the side opposite the proximal end 12A. The o-ring 20 preferably has an outer diameter slightly greater than the inner diameter of the housing 12. The inner diameter of the o-ring 20 is preferably smaller than the outer diameter of the stopper 16 such that the top portion 16A of the stopper 16 does not move beyond the o-ring 20 but such a size as to allow the middle portion 16B of the stopper 16 to extend beyond the o-ring 20. The o-ring 20 preferably has an outer diameter of 0.703 inches (1.786 cm) and an inner diameter of 0.563 inches (1.429 cm) and is 0.072 inches (0.183 cm) wide. The o-ring 20 is mounted in the housing 12 after the stopper 16 and the spring 18 are positioned in the passage 12D of the housing 12. When the assembly 10 is connected to the dispensing end 104B of the spout 104, the o-ring 20 is sandwiched between the end of the threaded connector 132 and the stopper 16 and acts as a seal such as to prevent liquid in the dispensing end 104B of the spout 104 from escaping around the stopper 16 when the stopper 16 is in the closed, deactivated position. The o-ring 20 is preferably constructed of vinton and is similar to conventional o-rings well known in the art.

IN USE

Prior to attachment to the nozzle 100, the assembly 10 is fully assembled such that the spring 18 and stopper 16 are in place in the passage 12D of the housing 12 and the threaded connector 132 is threadably engaged in the proximal end 12A of the housing 12 and acts to hold the valve 14 in place in the housing 12. The non-drip assembly 10 is attached on the dispensing end 104B of the liquid dispensing nozzle 100 using the threaded connector 132. The nozzle 100 is preferably a standard liquid dispensing nozzle 100 with the inner surface of the dispensing end 104B of the nozzle 100 provided with threads 104C which mate with the threads 132A of the connector 132 which is threadably mated at the other end to the assembly 10. The assembly 10 may also be permanently connected to the nozzle 100 such as by welding or through use of an adhesive. Alternatively, the assembly 10 may be constructed as part of the nozzle 100. The nozzle 100 is preferably provided with an automatic shut-off sleeve 112 and a vapor receiving boot 130. However, the non-drip valve assembly 10 does not interfere with the other systems on the nozzle 100 and the other systems are not necessary for the assembly 10 to operate correctly. Once the assembly 10 is securely attached to the dispensing end 104B of the spout 104, the nozzle 100 is used in the conventional manner to fill the container or vehicle fuel tank 150 with the liquid.

First the dispensing end 104B of the spout 104 of the nozzle 100 with the assembly 10 is inserted into the opening 150A of the fuel tank 150. As the dispenser enters the fuel tank 150, the sliding sleeve 112 contacts the rim 150B around the opening 150A and is prevented from moving forward along with the dispensing end 104B. As the spout 104 is further inserted into the fuel tank 150, the sliding sleeve 112 is moved further up the spout 104 toward the handle portion 102 of the nozzle 100. The movement of the sliding sleeve 112 up the spout 104 exposes the venturi opening 110 and thus, the orifice in the end fitting 109 of the venturi tube 108. Once the nozzle 100 is fully inserted into the fuel tank 150, the trigger 106 on the handle portion 102 of the nozzle 100 is pulled to activate the nozzle 100.

Activation of the nozzle 100 causes the liquid to flow from the liquid source (not shown) through the handle portion 102 of the nozzle 100 and into the spout 104 of the nozzle 100. As the liquid reaches the dispensing end 104B of the spout 104, the liquid comes in contact with the extreme end 16D of the bottom portion 16C of the stopper 16 and acts to move the stopper 16 along the longitudinal axis A—A of the assembly 10 away from the opening 12E in the proximal end 12A of the housing 12 of the assembly 10. As the stopper 16 is moved away from the opening into the open position, the liquid enters the passage 12D of the housing 12 and exits the housing 12 through the apertures 12G in the sidewall 12C of the housing 12. The concave surface of the extreme end 16D of the stopper 16 provides enough surface area such that the force of the liquid moves the stopper 16 out of the opening 12E. The frusto-conical shape of the bottom portion 16C of the stopper 16 allows the fluid to flow unhindered around the stopper 16 and out the apertures 12G in the sidewall 16E. The assembly 10 remains open until the nozzle 100 is deactivated.

The nozzle 100 may be deactivated in several ways. One way is for the user to release the trigger 106. Another way is for the liquid level in the fuel tank 150 to reach the venturi opening 110 located at the dispensing end 104B of the spout 104 which causes the venturi valve to be triggered to deactivate the nozzle 100. Still, another way is for the user to remove the nozzle 100 from the tank 150 without releasing the trigger 106. As the spout 104 is removed from the fuel tank 150, the return spring 114 of the shut-off sleeve 112 biases the sleeve 112 back down the spout 104 toward the dispensing end 104B of the spout 104. Once the nozzle 100 is removed from the fuel tank 150 beyond the venturi opening 110, the sleeve 112 is in the fully closed position with the plunger 116 in place over the venturi opening 110. When the sliding sleeve 112 moves back to the deactivated position, the ball 118 of the spring and ball plunger 116 is pushed into the venturi opening 110 by the force of the spring 18 thus, deactivating the nozzle 100. The ball and spring plunger 116 acts to close the venturi tube 108 which deactivates the nozzle 100 and causes the liquid flow in the nozzle 100 to cease. The position of the sleeve 112 over the venturi opening 110 also prevents the activation of the nozzle 100 when the nozzle 100 is removed from the fuel tank 150. In the preferred embodiment, the sliding sleeve 112 is easily moved up the nozzle 100 in response to contact with the rim 150B of the opening 150A fuel tank 150. However, as soon as the sleeve 112 is no longer being held up by the fuel tank 150, the return spring 114 moves the sliding sleeve 112 back to the original, deactivated position.

Once the flow of liquid in the nozzle 100 stops or decreases significantly, the spring 18 of the valve 14 acts to move the stopper 16 back towards the opening 12E and into the closed position. Preferably, the spring 18 is of such a force as to enable the pressure of the liquid in the nozzle 100 to move the stopper 16 against the bias of the spring 18. But at the same time, the spring 18 is of such a force as to move the stopper 16 back into the opening 12E once the liquid pressure decreases. The exact force of the spring 18 will depend on the pressure of the liquid and the changes in the pressure of the liquid which is not a result of deactivation of the nozzle 100. In the standard liquid dispensing nozzle 100 used to fill fuel tanks 150 in vehicles, the liquid has a pressure of 8 to 15 PSI. However, the assembly 10 may be used with liquids having a pressure between approximately about 2 and 200 PSI. The force of the spring 18 of the valve 14 depends on the pressure of the liquid.

Once the stopper 16 is in the fully closed position, the o-ring 20 between the threaded connector 132 and the stopper 16 acts as a seal between the outside surface of the middle portion 16B of the stopper 16 and the threaded connector 132 as the stopper 16 prevents the liquid remaining in the dispensing end 104B of the nozzle 100 from entering and escaping through the assembly 10. What little liquid remains in the assembly 10 will gradually exit through the apertures 12G in the sidewall 12C or alternatively, through the hole 12H in the distal end 12B of the housing 12. Consequently, when the user removes the dispensing end 104B of the nozzle 100 from the fuel tank 150, all of the liquid is out of the assembly 10 or trapped in the nozzle 100 which eliminates the dripping of the liquid.

It is intended that the foregoing description be only illustrative of the present invention and that the present invention be limited only by the hereinafter appended claims.

I claim:

1. A non-drip assembly for use with a liquid dispensing nozzle, which comprises:

(a) a conduit having opposed ends with a sidewall therebetween providing a channel along a longitudinal axis of the assembly, the sidewall having an aperture and one of the ends of the conduit having an opening and being configured to connect to a dispensing end of the liquid dispensing nozzle wherein an inner surface of the one end of the conduit has threads which mate with threads on an outer surface of a threaded connector which is mounted in the dispensing end of the nozzle;

(b) a valve means mounted in the channel of the conduit adjacent the aperture in the sidewall to control a flow of liquid into the assembly including:

(i) a stopper mounted adjacent to the opening in the one end of the conduit and configured to extend into the opening in the one end of the conduit to close the opening to prevent the flow of liquid into the assembly;

(ii) a biasing means mounted adjacent the stopper to move the stopper into the opening in the one end of the conduit wherein after deactivation of the nozzle, liquid pressure forcing the stopper in a direction away from the opening is less than a force of the biasing means tending to move the stopper toward the opening.

2. The assembly of claim 1 wherein the biasing means is a coil spring.

3. The assembly of claim 1 wherein the stopper is constructed of nylon.

4. The assembly of claim 1 wherein the stopper has a frusto-conical bottom portion and wherein when the nozzle is deactivated, the stopper is positioned such that the bottom portion extends into the opening in the one end of the conduit to close the opening in the one end of the conduit.

5. The assembly of claim 4 wherein the bottom portion of the stopper has sides having approximately a 30° angle.

6. The assembly of claim 1 wherein the sidewall of the conduit has at least four (4) apertures extending along the longitudinal axis of the assembly.

7. The assembly of claim 1 wherein when fully inserted in the opening in the one end of the conduit, the stopper extends about 0.25 inches (0.64 cm) into the dispensing end of the nozzle.

8. The assembly of claim 1 wherein an outer diameter of a top portion of the stopper is smaller than an inner diameter of the conduit.

9. The assembly of claim 1 wherein the stopper moves toward and away from the opening in the one end of the conduit along the longitudinal axis of the assembly.

10. The assembly of claim 1 wherein an inner ring is mounted adjacent the threads on the inner surface of the conduit on a side opposite the opening and forms a seal between the stopper and the inner surface of the conduit adjacent the opening in the one end of the conduit.

11. The assembly of claim 1 wherein the threaded connector has an inner diameter less than an outer diameter of a bottom portion of the stopper adjacent a top portion of the stopper so that the threaded connector prevents the stopper from extending completely through the opening.

12. In a liquid dispensing nozzle, the improvement which comprises:

a conduit having a proximal end and an opposed distal end with a sidewall therebetween providing a channel through the conduit, the proximal end being connected to a handle of the nozzle and the sidewall having an aperture adjacent the distal end for dispensing a liquid;

a valve means mounted in the channel at the distal end of the conduit adjacent the aperture in the sidewall and including:

(i) a stopper to control a flow of the liquid through the aperture in the sidewall of the conduit; and (ii) a biasing means to move the stopper to close the channel of the conduit adjacent the aperture in the sidewall to prevent the liquid from exiting the conduit through the aperture in the sidewall after the nozzle has been deactivated;

a venturi shut-off mechanism having a venturi tube extending along the channel of the conduit from the handle of the nozzle to a venturi opening in the sidewall of the conduit adjacent the aperture;

an automatic shut-off sleeve slidably mounted around an outside surface of the conduit which acts to close off the venturi opening when the sleeve is fully forward in a closed position; and a plunger provided in the sleeve which extends into the venturi opening and seals the venturi opening so as to trigger the venturi shut-off mechanism to deactivate the nozzle and stop the flow of liquid in the nozzle.

13. The nozzle of claim 12 wherein an inner ring at the distal end of the conduit adjacent the aperture in the sidewall acts to stop the movement of the stopper toward the proximal end of the conduit.

14. The nozzle of claim 12 wherein, in use, the sleeve is moved to an open position due to contact with a rim around an opening of a container, which acts to slide the sleeve along a length of the conduit of the nozzle toward the handle of the nozzle as the distal end of the conduit is extended into the opening of the container.

15. The nozzle of claim 14 wherein a returning means is mounted between the sleeve and the handle of the nozzle for moving the sleeve into the closed position once the sleeve is no longer in contact with the rim of the container.

16. The nozzle of claim 15 wherein the plunger is a spring and ball plunger having a spring and a ball and wherein the spring biases the ball into the venturi opening once the sleeve is fully forward in the closed position.

17. The nozzle of claim 16 wherein a diameter of the ball of the spring and ball plunger is less than a diameter of the venturi opening but greater than a diameter of the venturi tube such that the ball fits within the opening and completely closes an open distal end of the venturi tube such as to create a sealed closure.

18. The nozzle of claim 17 wherein the sleeve has a locating means which prevents the sleeve from rotating around the conduit of the nozzle.

19. The nozzle of claim 12 wherein a vapor recovering boot is mounted around the conduit of the nozzle.

20. In a liquid dispensing nozzle including a conduit having a proximal end and an opposed distal end with a sidewall therebetween providing a channel through the conduit, the proximal end being connected to a handle of the nozzle and the distal end having an opening for dispensing a liquid;

a venturi shut off mechanism for deactivating the nozzle, having a venturi tube extending along the channel of the conduit from the handle of the nozzle to a venturi opening in the sidewall of the conduit adjacent the distal end of the conduit, the improvement which comprises:

a shut off sleeve slidably mounted around an outside surface of the conduit;

a plunger mounted in the sleeve such that a ball of the plunger extends into the venturi opening when the sleeve is in the fully forward position and acts to close off the venturi opening such as to deactivate the nozzle; and a biasing means mounted around the outside surface of the conduit between the sleeve and the proximal end of the conduit to move the sleeve into the fully forward position when the nozzle is removed from a container.

* * * * *